US006915800B2

(12) United States Patent
Hwang

(10) Patent No.: US 6,915,800 B2
(45) Date of Patent: Jul. 12, 2005

(54) WATER INTAKE PREVENTION DEVICE FOR A SNORKEL

(76) Inventor: Kee Y. Hwang, 10320 Judy Ave., Cupertino, CA (US) 95014

( * ) Notice: Subject to any disclaimer, the term of this patent is extended or adjusted under 35 U.S.C. 154(b) by 36 days.

(21) Appl. No.: 10/639,152

(22) Filed: Aug. 11, 2003

(65) Prior Publication Data

US 2005/0081848 A1 Apr. 21, 2005

(51) Int. Cl.[7] ..... B63C 11/16

(52) U.S. Cl. ..... 128/201.11; 128/201.26; 128/201.27; 128/206.29

(58) Field of Search ..... 128/201.11, 201.29, 128/201.27, 201.28, 201.26, 206.29; 405/186, 187, 188

(56) References Cited

U.S. PATENT DOCUMENTS 4,805,610 A * 2/1989 Hunt ..... 128/201.11
5,117,817 A * 6/1992 Lin ..... 128/201.11
5,351,681 A * 10/1994 Hudson ..... 128/201.11

* cited by examiner

*Primary Examiner*—Henry Bennett
*Assistant Examiner*—Andrea M. Ragonese
(74) *Attorney, Agent, or Firm*—The Kline Law Firm

(57) ABSTRACT

A water intake prevention device for a snorkel includes an outer housing that is affixed to the airway tube of a snorkel. The outer housing includes a plurality of inlet openings to allow the intake of air. An inner housing of the device includes a float that moves in an interior of the inner housing. When a diver drops to a depth at which the snorkel is underwater, water flows into the air inlets. The water raises the float within the interior of the inner housing, so that a tapered upper end of the float seals an airway opening, thereby preventing the flow of water through the airway. The inlet openings of the outer housing must be below and isolated from the airway opening in the inner housing and isolated from the airway of the snorkel.

16 Claims, 3 Drawing Sheets

WATER INTAKE PREVENTION DEVICE FOR A SNORKEL

BACKGROUND OF THE INVENTION

1. Field of the Invention

The present invention relates generally to a swimming aid apparatus, and more particularly is a water intake prevention device for a snorkel.

2. Description of the Prior Art

Snorkeling is a very popular and enjoyable pastime. Divers and swimmers use the snorkel to enable them to breath with their face beneath the surface of the water. Proper operation requires that the user maintain an appropriate depth just beneath the surface. If the swimmer descends to a depth that exceeds the reach of his snorkel, he will draw water into the air intake ports of the snorkel, instead of the desired and critical air. The water must then be purged from the snorkel by "blowing"—forming sufficient pressure to force the water out of the snorkel tube, thereby allowing air to again be drawn into the snorkel. Since dipping below the proper water depth is quite common, many devices in the prior art have been generated to address this problem.

One such device is the "Vertical Co-Axial Multi-Tubular Diving Snorkel" of Lin, U.S. Pat. No. 5,117,817, issued Jun. 2, 1992. This reference discloses a float within an outer housing, the float rising to block intake ports when the device is under water.

The "Dryest Snorkel" of Christianson, U.S. Pat. No. 6,371,108, issued Apr. 16, 2002, discloses another float type device. This device has an exterior float that blocks exterior intake ports.

The "Swimmer's Snorkel" of Hunt, U.S. Pat. No. 4,805,610, issued Feb. 21, 1989, is another exterior float device. This device uses a ball to block the intake port when the outer float is raised by the water level.

The "Snorkel System" of Vinokur, et al., U.S. Pat. No. 6,513,520, issued Feb. 4, 2003, utilizes an expanded housing fitted around the upper end of the breathing tube. There is no float device used, the housing just serves as a pressure chamber that allows the diver to create enough pressure to keep water out of the housing, and hence the airway.

Although the prior art devices are many and varied, they all suffer from soluble drawbacks. The ball valve devices are bulky, tend to snag, and often do not completely block the passage of water. Devices with an exterior float are also prone to snag and foul on various obstructions, such as seaweed and grasses, encountered by the diver. Still other current art devices utilize means to block the entry of water that also restrict the entry of air, thereby making breathing difficult even when the snorkel is above the water level.

Accordingly, it is an object of the present invention to provide a snorkel device that effectively blocks the entry of water into the airway, even when the airway entry port is beneath the surface of the water.

It is another object of the present invention to provide a structure for the device that is not likely to snag or jam.

It is still another object of the present invention to provide a device that is simple to manufacture.

SUMMARY OF THE INVENTION

The present invention is a water intake prevention device for a snorkel. The device comprises an outer housing that is affixed to the airway tube of a snorkel. The outer housing includes a plurality of inlet openings to allow the intake of air. An inner housing of the device includes a float that moves in an interior of the inner housing. When a diver drops to a depth at which the snorkel is underwater, water flows into the air inlets. The water raises the float within the interior of the inner housing, so that a tapered upper end of the float seals an airway opening, thereby preventing the flow of water through the airway. The inlet openings of the outer housing must be below and isolated from the airway opening in the inner housing and isolated from the airway of the snorkel.

As the diver moves closer to the surface of the water, the float drops out of the airway opening in the inner housing, so that air can again flow through the airway of the snorkel. The water that had entered the housing flows out through the intake openings, so that the snorkel airway remains free of any water.

An advantage of the present invention is that it operates very efficiently, eliminating the entry of water into the snorkel airway.

Another advantage of the present invention is that it simple design reduces significantly the possibility of mechanical failure of the device.

A still further advantage of the present invention is that it is inexpensive to manufacture.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
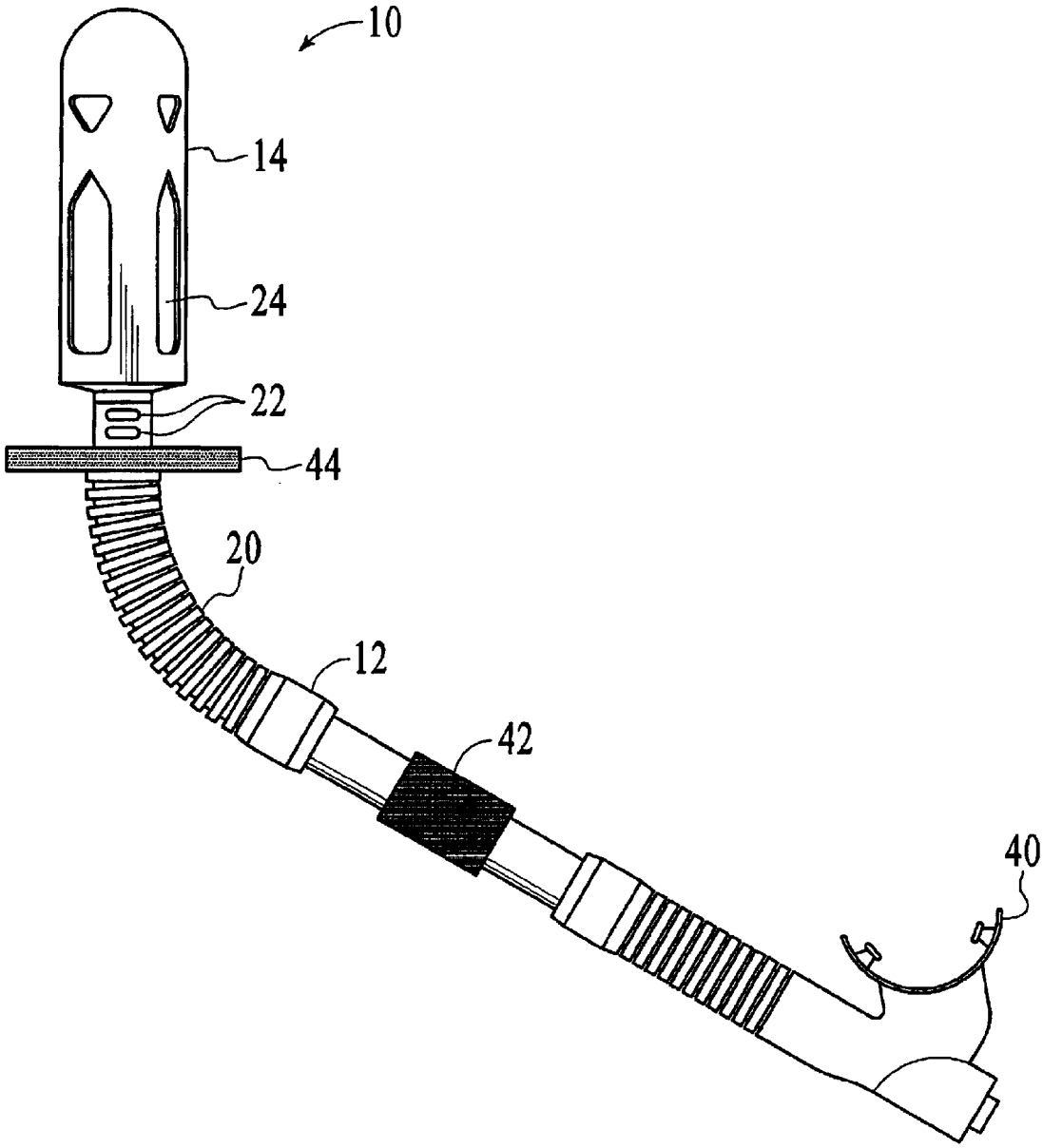
FIG. 1 is a perspective view of a snorkel with a water intake prevention device of the present invention attached.

The present invention is a water intake prevention device 10 for a snorkel 12. The water intake prevention device 10 comprises an outer housing 14 and an inner housing 16. The base of the outer housing 16 includes a securing mechanism 18 that affixes the water intake prevention device 10 to an airway tube 20 of the snorkel 12. In the preferred embodiment, the securing mechanism 18 comprises two pairs of protrusions that are received in apertures 22 in the upper end of the airway tube 20.

Figure 2:
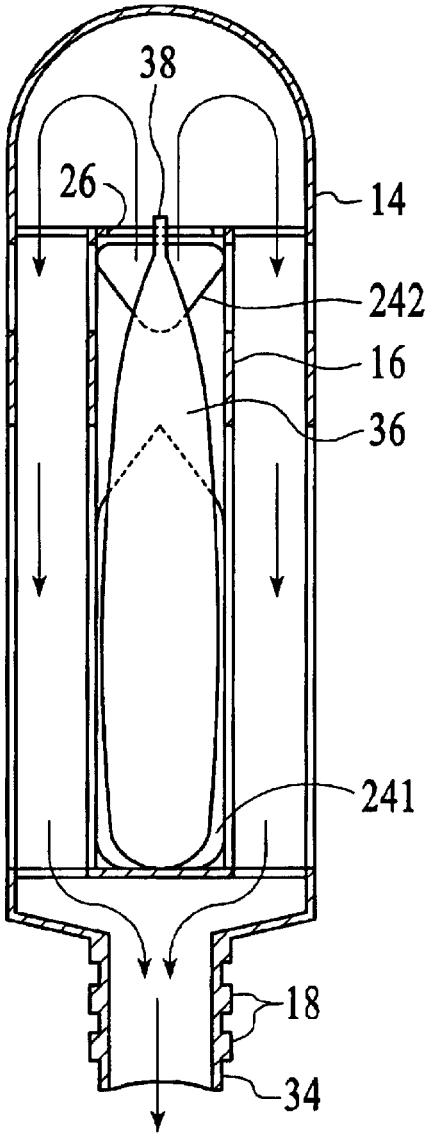
FIG. 2 is a sectional view of the water intake prevention device with the float in the open position.
Figure 4:
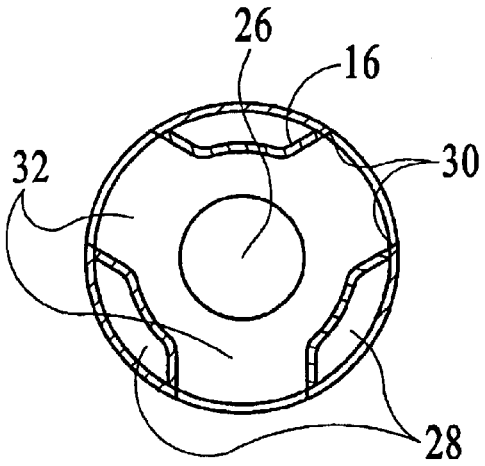
FIG. 4 is a radial sectional view of the water intake prevention device.
Figure 5:
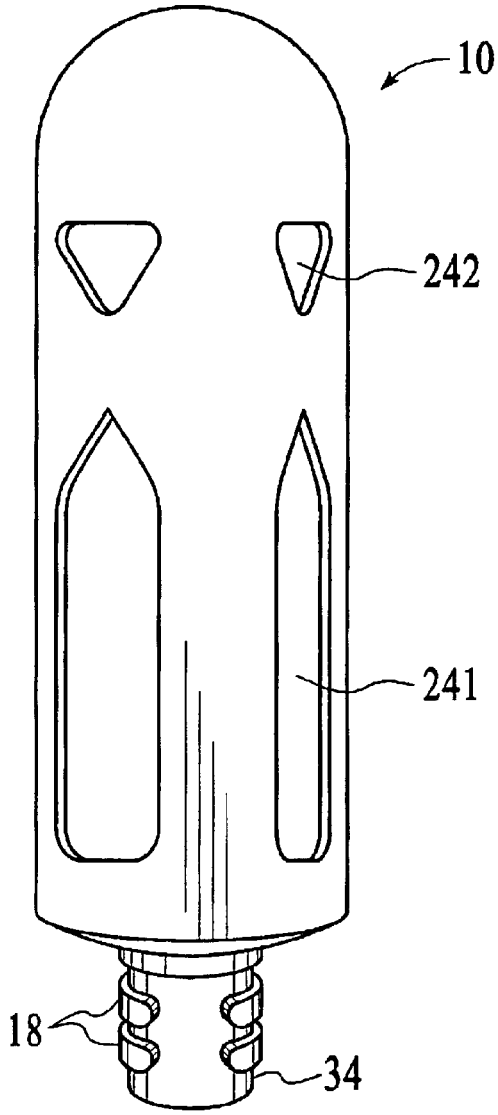
FIG. 5 is a perspective view of the water intake prevention device.

The outer housing 14 further comprises at least one flow opening 24 to allow the intake of air. In the preferred embodiment, three sets of lower openings 241 and upper openings 242 are spaced around the outer housing 14 at 120° intervals. The use of lower and upper flow openings 241, 242 allows the airway of the snorkel 20 to remain open as long as possible as the diver descends. Lower and upper openings 241, 242 pass through the inner housing 16 as well, and are thereby in communication with a float opening 26 in the top of the inner housing 16. The float opening 26 is in communication with at least one airway passage 28 that is defined between the outer housing 14 and the inner housing 16. (See FIG. 4.) In order to form the airway passage 28, the inner housing 16 must be attached to the outer housing 14 by at least two joining surfaces 30. In the preferred embodiment of the device, the inner housing 16 is formed with three protruding nodes 32, each of the nodes 32 being attached to an inner side of the outer housing 14. This configuration forms three airway passages 28 that feed into a neck 34 of the outer housing 14. The neck 34 of the outer housing 14 is in turn connected to the upper end of the airway tube 20 of the snorkel 12, thereby establishing the airway to the diver's mouth. The direction of air flow through the snorkel 12 is indicated by the arrows in FIG. 2.

A float 36 is contained in the inner housing 16. When water enters the lower openings 241, the float 36 rises to the top of the inner housing 16 (see FIG. 3), where it blocks the float opening 26. In the preferred embodiment, the float 36 has a tapered upper end 38 so as to be readily guided into the opening 26. In order to maximize the sealing nature of the tapered upper end 38, it may be covered with a rubber sleeve, or the float 36 may be made entirely of rubber. It should be recognized by those skilled in the art that nearly any shape of float 36 can be used (such as simply spherical) so long as the float 36 blocks the float opening 26 when the float 36 rises to the top of the inner housing 16.

It should be noted that a key construction consideration for the water intake prevention device 10 of the present invention is that the opening or openings 24 of the outer housing 14 must be positioned below and isolated from the float opening 26 in the inner housing 16 that defines the airway of the snorkel 12.

In order to help the snorkel 12 maintain the proper orientation while the diver moves about, the snorkel 12 includes a flex joint 42 and a flotation disk 44. The flex joint 42 is made of fabric or the like so as to not provide any resistance to bending. The flex joint is installed in the snorkel 12 at some point along the airway tube 20. The flotation disk 44 is affixed to the airway tube 20 just beneath the water intake prevention device 10. While nearly any buoyant material will suffice, the flotation disk 44 is typically a foam disk. With the flex joint 42 and the flotation disk 44, no matter how the diver moves his body relative to the snorkel 12, the water intake prevention device 10 remains in the desired upright orientation.

Use of the water intake prevention device 10 is as follows: When a user, a diver, is floating at a depth at which the water intake prevention device 10 extends above the surface of the water, the diver breathes through the snorkel mouthpiece 40. Air is drawn into the inner housing 16 through the lower and upper openings 241, 242. The air passes out of the inner housing 16 through the float opening 26 and down through the airway passages 28 to the neck 34 of the outer housing 14 which is inserted into the airway tube 20 of the snorkel 12. The float 36 is in the open position shown in FIG. 2.

Figure 3:
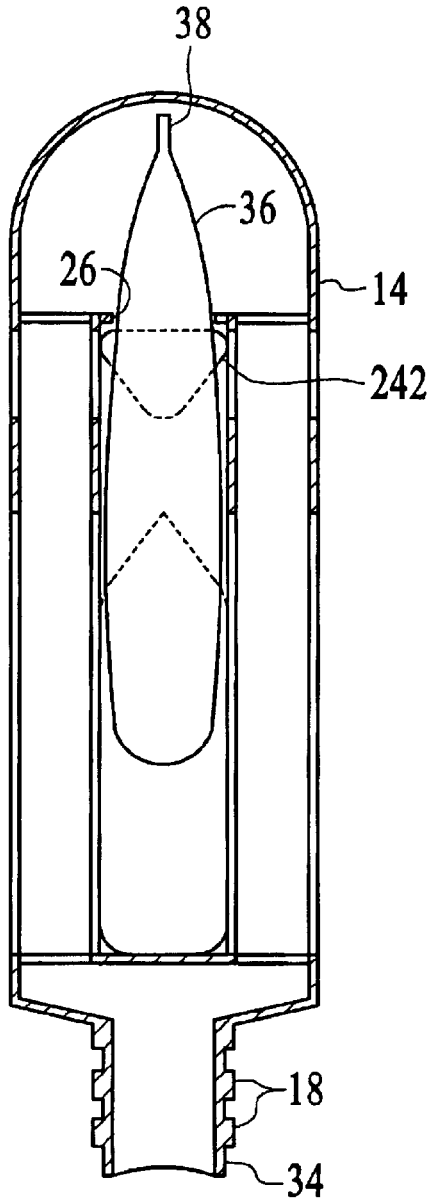
FIG. 3 is a sectional view of the water intake prevention device with the float in the closed position.

When the diver drops to a depth at which the water intake prevention device 10 of the snorkel 12 is underwater, water flows through the openings 241, 242 into the inner housing 16. The water raises the float 36 within the interior of the inner housing 16. When the float 36 reaches the top of the inner housing 16, a tapered upper end 38 of the float 36 passes through the float opening 26. The rising water forces the float 36 to securely close the float opening 26, thereby sealing the airway of the snorkel 12 before water can enter the airway. The float 36 in the closed position is shown in FIG. 3.

As the diver moves closer to the surface of the water during his ascension, water flows out of the inner housing 16 through the openings 241, 242, so that the float 36 drops out of the float opening 26 as the water level drops. When the float opening 26 is opened, the airway of the snorkel 12 is again clear, so that the diver can breathe freely through the mouthpiece 40 of the snorkel 12.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A water intake prevention device in combination with a snorkel comprising:

an outer housing with at least one flow opening that allows air and water to flow therethrough, said outer housing further comprising a neck that is in communication with an airway tube of said snorkel, an inner housing that is connected on at least two joining surfaces to said outer housing such that said inner housing is fixed in position relative to said outer housing, said inner housing comprising a float hole in a top side thereof, at least one airway passage defined between said outer housing and said inner housing, said airway passage being in communication with said float hole and with said neck of said outer housing, and a float device contained in said inner housing; wherein when a water level is below said flow opening, air flows freely into said inner housing through said flow opening, out of said inner housing through said float hole, through said airway passage and through said neck of said outer housing, and when the water level is above a lower side of said flow opening, water flows into said inner housing, causing said float to rise on said water, and when the water level rises to a sufficient level, said float is forced into said float hole, thereby blocking said float hole so that no water enters said airway passage, and when the water level recedes, said float drops out of said float hole, again allowing a free flow of air through said airway passage.

2. The water intake prevention device in combination with a snorkel as defined in claim 1 wherein:

an airway tube of said snorkel comprises a flex joint that provides no resistance to bending.

3. The water intake prevention device in combination with a snorkel as defined in claim 2 wherein:

a flotation ring formed from a buoyant material is positioned on said snorkel below said water intake prevention device.

4. The water intake prevention device in combination with a snorkel as defined in claim 1 wherein:

said device comprises a plurality of flow openings.

5. The water intake prevention device in combination with a snorkel as defined in claim 1 wherein:

said device comprises a plurality of airway passages.

6. The water intake prevention device in combination with a snorkel as defined in claim 1 wherein:

said float has a tapered upper end.

7. A water intake prevention device in combination with a snorkel comprising:

an outer housing with at least one flow opening that allows air and water to flow therethrough, said outer housing further comprising a neck that is in communication with an airway tube of said snorkel, an inner housing comprising three nodes, each said node being connected to said outer housing such that said inner housing is fixed in position in an interior of said outer housing, said inner housing comprising a float hole in a top side thereof, three airway passages defined between said outer housing and said inner housing, each said airway passage being in communication with said float hole and with said neck of said outer housing, and a float device contained in said inner housing; wherein when a water level is below said flow opening, air flows freely into said inner housing through said flow opening, out of said inner housing through said float hole, through said airway passages and through said neck of said outer housing, and when the water level is above a lower side of said flow opening, water flows into said inner housing, causing said float to rise on said water, and when the water level rises to a sufficient level, said float is forced into said float hole, thereby blocking said float hole so that no water enters said airway passages, and when the water level recedes, said float drops out of said float hole, again allowing a free flow of air through said airway passages.

8. The water intake prevention device in combination with a snorkel as defined in claim 7 wherein:

an airway tube of said snorkel comprises a flex joint that provides no resistance to bending.

9. The water intake prevention device in combination with a snorkel as defined in claim 8 wherein:

a flotation ring formed from a buoyant material is positioned on said snorkel below said water intake prevention device.

10. The water intake prevention device in combination with a snorkel as defined in claim 7 wherein:

said device comprises a plurality of flow openings.

11. The water intake prevention device in combination with a snorkel as defined in claim 7 wherein:

said float has a tapered upper end.

12. A water intake prevention device in combination with a snorkel comprising:

an outer housing with at least three flow openings that allow air and water to flow therethrough, said outer housing further comprising a neck that is in communication with an airway tube of said snorkel, an inner housing that is connected on at least two joining surfaces to said outer housing such that said inner housing is fixed in position relative to said outer housing, said inner housing comprising a float hole in a top side thereof, at least one airway passage defined between said outer housing and said inner housing, said airway passage being in communication with said float hole and with said neck of said outer housing, and a float device contained in said inner housing; wherein when a water level is below said flow openings, air flows freely into said inner housing through said flow openings, out of said inner housing through said float hole, through said airway passage and through said neck of said outer housing, and when the water level is above a lower side of at least one of said flow openings, water flows into said inner housing, causing said float to rise on said water, and when the water level rises to a sufficient level, said float is forced into said float hole, thereby blocking said float hole so that no water enters said airway passage, and when the water level recedes, said float drops out of said float hole, again allowing a free flow of air through said airway passage.

13. The water intake prevention device in combination with a snorkel as defined in claim 12 wherein:

an airway tube of said snorkel comprises a flex joint that provides no resistance to bending.

14. The water intake prevention device in combination with a snorkel as defined in claim 13 wherein:

a flotation ring formed from a buoyant material is positioned on said snorkel below said water intake prevention device.

15. The water intake prevention device in combination with a snorkel as defined in claim 12 wherein:

said device comprises a plurality of airway passages.

16. The water intake prevention device in combination with a snorkel as defined in claim 12 wherein:

said float has a tapered upper end.

* * * * *